US011903505B2

(12) United States Patent
Zhao

(10) Patent No.: US 11,903,505 B2
(45) Date of Patent: Feb. 20, 2024

(54) ASSEMBLED STAND FOR CHRISTMAS TREE AND SUPPORT MEMBER THEREFOR

(71) Applicant: NINGBO FLYING-HORSE INTERNATIONAL TRADE CO., LTD, Ningbo (CN)

(72) Inventor: Honghua Zhao, Ningbo (CN)

(73) Assignee: NINGBO FLYING-HORSE INTERNATIONAL TRADE CO., LTD, Ningbo (CN)

( * ) Notice: Subject to any disclaimer, the term of this patent is extended or adjusted under 35 U.S.C. 154(b) by 0 days.

(21) Appl. No.: 17/979,014

(22) Filed: Nov. 2, 2022

(65) Prior Publication Data

US 2023/0052498 A1 Feb. 16, 2023

(30) Foreign Application Priority Data

Aug. 17, 2022 (CN) ..... 202222171928.9

(51) Int. Cl.
*A47G 33/12* (2006.01)

(52) U.S. Cl.
CPC ..... *A47G 33/12* (2013.01)

(58) Field of Classification Search
CPC ..... A47G 33/12; A47G 2033/1286; F16M 11/22; F16M 2200/08
USPC ..... 248/158, 161, 404, 412, 157, 420, 248/229.13, 229.23, 231.51, 316.5; 47/42, 40.5
See application file for complete search history.

(56) References Cited

U.S. PATENT DOCUMENTS

| | | | | | |
|---|---|---|---|---|---|
| 1,895,717 | A * | 1/1933 | Kelley | A47G 33/12 | D11/182 |
| 5,743,508 | A * | 4/1998 | Fiveash | A47G 33/12 | 248/527 |
| 5,938,168 | A * | 8/1999 | Adams | A47G 33/12 | 248/524 |
| 6,320,327 | B1 * | 11/2001 | Lavatelli | A47G 33/126 | 315/185 S |
| D492,911 | S * | 7/2004 | Boucher | D11/130.1 | |
| 2006/0016955 | A1 * | 1/2006 | Kao | F16M 11/22 | 248/521 |
| 2010/0044545 | A1 | 2/2010 | Hackney | | |
| 2015/0335189 | A1 * | 11/2015 | Nally | F16M 11/16 | 248/516 |
| 2016/0037951 | A1 * | 2/2016 | Meves | A47G 33/12 | 47/40.5 |
| 2018/0110353 | A1 | 4/2018 | Wach | | |
| 2020/0352379 | A1 | 11/2020 | Fiveash | | |
| 2023/0052498 | A1 * | 2/2023 | Zhao | A47G 33/12 | |

* cited by examiner

*Primary Examiner* — Muhammad Ijaz

(57) ABSTRACT

The present disclosure provides an assembled stand for a Christmas tree and a support member thereof. The assembled stand includes a support portion and a carrier portion. The support portion includes at least three support members, wherein the support members are successively arranged along a circumferential direction, and when the support members are engaged with each other and are formed as the support portion, two adjacent support members are positioned relative to each other and are fixed by a first fixing member. According to the present disclosure, the volume during transportation may be reduced, and the assembly process is simplified.

17 Claims, 9 Drawing Sheets

ASSEMBLED STAND FOR CHRISTMAS TREE AND SUPPORT MEMBER THEREFOR

TECHNICAL FIELD

The present disclosure relates to the field of holiday decoration, and in particular, relates to an assembled stand for a Christmas tree for fixing the Christmas tree, and a support member therefor.

BACKGROUND

Christmas is a western traditional festival, and it is common to decorate Christmas trees during Christmas. Christmas trees are categorized into real trees and false trees. The real trees are trees of *Abies* of Pinaceae, and the false trees are made by artificial synthesis. Regardless of the real trees or false trees, Christmas tree stands are required to be fixed.

The conventional Christmas tree stands are mostly composed of a monolithic structure, which is disadvantageous for transportation. In the related art, there are tree stands assembled in a split assembling manner, but the structure thereof is not reasonable enough, and there are deficiencies in convenience of assembly, fastness upon assembling and aesthetics of the finished product.

SUMMARY

It is an object of the present disclosure to provide an assembled stand for a Christmas tree, which is easy for assembling and small for transportation.

To achieve the above object, the present disclosure employs the following technical solutions:

According to a first aspect of the present disclosure, an assembled stand for a Christmas tree is provided. The assembled stand includes:

a support portion, including at least three support members, the support members being successively arranged along a circumferential direction such that two sides of each of the support members are connected end to end and are formed as the support portion; and a carrier portion connected to the support portion, the carrier portion including a carrier cylinder, the carrier cylinder being hollowed out to define a carrier cavity configured to fix the Christmas tree, wherein the support portion and the carrier portion are fixed to each other via a first fixing member;

wherein a first connection portion and a second connection portion are arranged on two sides of each of the support members, such that when the support members are engaged with each other end to end, the first connection portion and the second connection portion of two adjacent support members are engaged with each other; wherein the first connection portion includes a first engagement portion, a second engagement portion and a first connection hole, and the second connection portion includes a third engagement portion, a fourth engagement portion, a second connection hole and a first positioning portion; wherein the first engagement portion and the second engagement portion are arranged along a vertical direction, and the first connection hole is arranged to run through the first engagement portion and the second engagement portion; the third engagement portion and the fourth engagement portion are arranged along a vertical direction, the second connection hole is arranged to run through the third engagement portion and the fourth engagement portion, and the first positioning portion is protruded from the third engagement portion; and the first engagement portion and the third engagement portion are columnar members, and the second engagement portion and the fourth engagement portion are columnar cavities; and wherein when the support members are connected end to end and are formed as the support portion, the first engagement portion of any of the support members is engaged to the fourth engagement portion of an adjacent support member, the third engagement portion of any of the support members is engaged to the second engagement portion of an adjacent support member, the first positioning portion is engaged to the first connection hole such that the first connection hole is arranged to be opposite to the second connection hole, and the first fixing member runs through the first connection hole and the second connection hole and is then fixed to the carrier cylinder.

According to a second aspect of the present disclosure, an assembled stand for a Christmas tree is provided. The assembled stand includes:

a support portion, including at least three support members, the support members being successively arranged along a circumferential direction such that two sides of each of the support members are connected end to end and are formed as the support portion; and a carrier portion connected to the support portion, the carrier portion including a carrier cylinder, the carrier cylinder being hollowed out to define a carrier cavity configured to fix the Christmas tree, wherein the support portion and the carrier portion are fixed to each other via a first fixing member;

wherein a first connection portion and a second connection portion are arranged on two sides of each of the support members, such that when the support members are engaged with each other end to end, the first connection portion and the second connection portion of two adjacent support members are engaged with each other; wherein the first connection portion includes a first engagement portion and a second engagement portion that are arranged along a vertical direction, and a first connection hole arranged to run through the first engagement portion and the second engagement portion; and the second connection portion includes a third engagement portion and a fourth engagement portion that are arranged along the vertical direction, and a second connection hole arranged to run through the third engagement portion and the fourth engagement portion; and wherein when the support members are connected end to end and are formed as the support portion, the first engagement portion of any of the support members is engaged to the fourth engagement portion of an adjacent support member, the third engagement portion of any of the support members is engaged to the second engagement portion of an adjacent support member, the first connection hole is arranged to be opposite to the second connection hole, and the first fixing member runs through the first connection hole and the second connection hole and is then fixed to the carrier cylinder.

According to a third aspect of the present disclosure, a support member for an assembled stand for a Christmas tree is provided. The support member includes:

a first connection portion, including a first engagement portion and a second engagement portion that are arranged along a vertical direction, and a first connection hole arranged to run through the first engagement portion and the second engagement portion; and a second connection portion; wherein the first connection portion and the second connection portion are respectively arranged on two sides of the support member; and the second connection portion includes a third engagement portion and a fourth engagement portion that are arranged along the vertical direction, and a second connection hole arranged to run through the third engagement portion and the fourth engagement portion;

wherein the first engagement portion and the third engagement portion are protrusions, and the second engagement portion and the fourth engagement portion are recesses such that the engagement portions are engaged with each other in a concave-convex manner when at least three of the support members are connected end to end along a circumferential direction; and the first connection hole and the second connection hole are arranged to be opposite to each other such that the same fixing member is capable of simultaneously fixing two adjacent support members.

The assembled stand for the Christmas tree and the support member therefor according to the present disclosure achieve the following beneficial effects:

1. The parts are assembled to form a finished product of the stand for the Christmas tree, and the packaging volume may be reduced during transportation, which is conducive to lowering transportation costs.
2. Upon assembling, the structure is firm and secure and free of collapse, and the finished product is beautiful.
3. The support members are connected end to end on two sides in the circumferential direction and fixed by the first fixing member, such that one fixing member is capable of simultaneously fixing two adjacent support members, which reduces the number of parts, cost, and difficulty of mounting.
4. The support portion is in smooth contact with the bottom surface and the carrier portion, and the structure is firm and aesthetically pleasing.
5. The carrier portion includes an adjustment member that may be configured to adjust the position relative to the carrier cylinder, such that the stand of the tree is adaptive to fixation of Christmas trees of different sizes.
6. The support portions have the same shape and may be produced from the same mold, such that the production and assembling processes are simplified, and the mold does not need to be designed dedicatedly for each support member in the production and the support members do not need to be distinguished from each other in mounting.
7. A self-locking structure is arranged between the support members, and self-positioning and preliminary assembling locking of the support portion may be achieved without using additional fixing members upon pre-assembling, which is conducive to subsequent assembling.
8. The first fixing member and the second fixing member are both made of nuts and are connected to the carrier cylinder by welding, such that the production process of the carrier portion is simplified, the costs are reduced and the firmness are enhanced relative to opening holes in the carrier cylinder.

DETAILED DESCRIPTION

Figure 1:
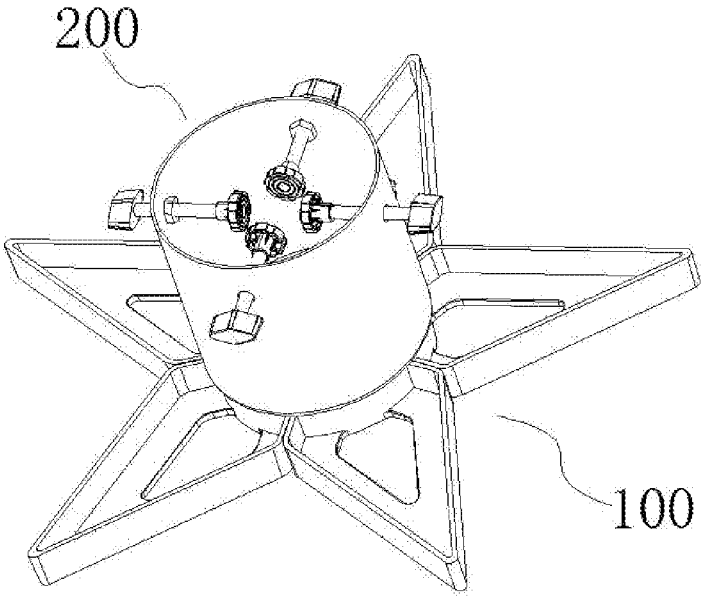
FIG. 1 is a schematic top perspective view of an assembled stand for a Christmas tree according to a first embodiment of the present disclosure.

For better understanding of the present disclosure by a person skilled in the art and for more clear definition of the protection scope of the present disclosure, the present disclosure is described hereinafter in detail with reference to some specific embodiments. It should be noted that the specific embodiments construed for the present disclosure are only illustrated, which are merely a part of embodiments of the present disclosure. The specific and direct descriptions of the related structures are only for ease of understanding of the present disclosure, and various specific features are not intended to directly limit the practice of the present disclosure. Any customary selections and replacements made by a person skilled in the art under the concept of the present disclosure shall all be considered as falling within the protection scope of the present disclosure.

An assembled stand for a Christmas tree is provided. The assembled stand includes a support portion 100 and a carrier portion 200 connected to the support portion 100. The carrier portion 200 includes a carrier cylinder 201, wherein the carrier cylinder 201 is hollowed out to define a carrier cavity 202. The support portion 100 includes at least three support members 11, wherein the support members 11 are successively arranged along a circumferential direction such that two sides of each of the support members 11 are connected end to end and are formed as the support portion. The support portion 100 and the carrier portion 200 are fixed to each other via a first fixing member 101.

A first connection portion 31 and a second connection portion 32 are arranged on two sides of each of the support members 11, such that when the support members are engaged with each other end to end, the first connection portion 31 and the second connection portion 32 of two adjacent support members 11 are engaged with each other. The first connection portion 31 includes a first engagement portion 311, a second engagement portion 312 and a first connection hole 313 that is arranged to run through the first engagement portion 311 and the second engagement portion 312; and the second connection portion 32 includes a third engagement portion 321 and a fourth engagement portion 322 that are arranged along a vertical direction, and a second connection hole 323 that is arranged to run through the third engagement portion 321 and the fourth engagement portion 322.

After the support members 11 are connected end to end and are formed as the support portion 100, the first engagement portion 311 of any of the support members 11 is engaged with the fourth engagement portion 322 of an adjacent support member 11, the third engagement portion 321 of any of the support members 11 is engaged to the second engagement portion 312 of an adjacent support member 11, the first connection hole 313 is arranged to be opposite to the second connection hole 323, the first fixing member 101 runs through the first connection hole 313 and the second connection hole 323 and is then fixed to the carrier cylinder 201, and the first fixing member 101 is arranged at a joint of two adjacent support members 11 to simultaneously fix two adjacent support members 11 to the carrier cylinder 201.

Preferably, the second connection portion 32 or the first connection portion 31 is further provided with a first positioning portion 325. The first positioning portion 325 is protruded from the first engagement portion 311 or the third engagement portion 321 such that the first positioning portion 325 is embedded into the first connection hole 313 or the second connection hole 323 upon engagement. In this way, the support members 11 to be pre-assembled are initially positioned, such that the support portion 100 formed by pre-assembling is formed as an integrally movable or fixed entirety, thereby simplifying mounting procedures.

A support member for an assembled stand for a Christmas tree is further provided. The support member has the structure of the support member as described above, and is used in assembling the stand for the Christmas tree.

First Embodiment

Figure 2:
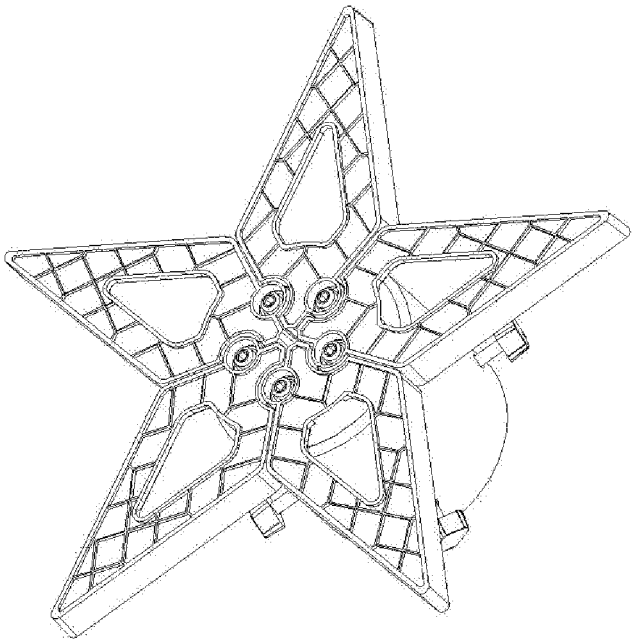
FIG. 2 is a schematic bottom view according to the embodiment as illustrated in FIG. 1.

As illustrated in FIG. 1 and FIG. 2, an assembled stand for a Christmas tree includes a support portion 100 and a carrier portion 200 connected to the support portion 100, to form an entire assembled stand for the Christmas tree. The support portion 100 is configured to be in contact with an outer support face, for example, a ground or the like, to provide a support force; and the carrier portion 200 is configured to allow a trunk of the Christmas tree to be received therein and fix the trunk.

In this embodiment, the support portion 100 of the assembled stand is in five-pointed star shape, and includes support members 11 extending respectively outward along five directions. In addition, outer ends of the support members 11 are arranged to go beyond the carrier portion 200, such that the assembled stand is stable for placement.

In this embodiment, the support members 11 may also be arranged to extend outward horizontally. In other embodiments, the support members 11 may also be arranged to extend outward and downward, and tail ends of the support members 11 are in a same horizontal plane.

Figure 3:
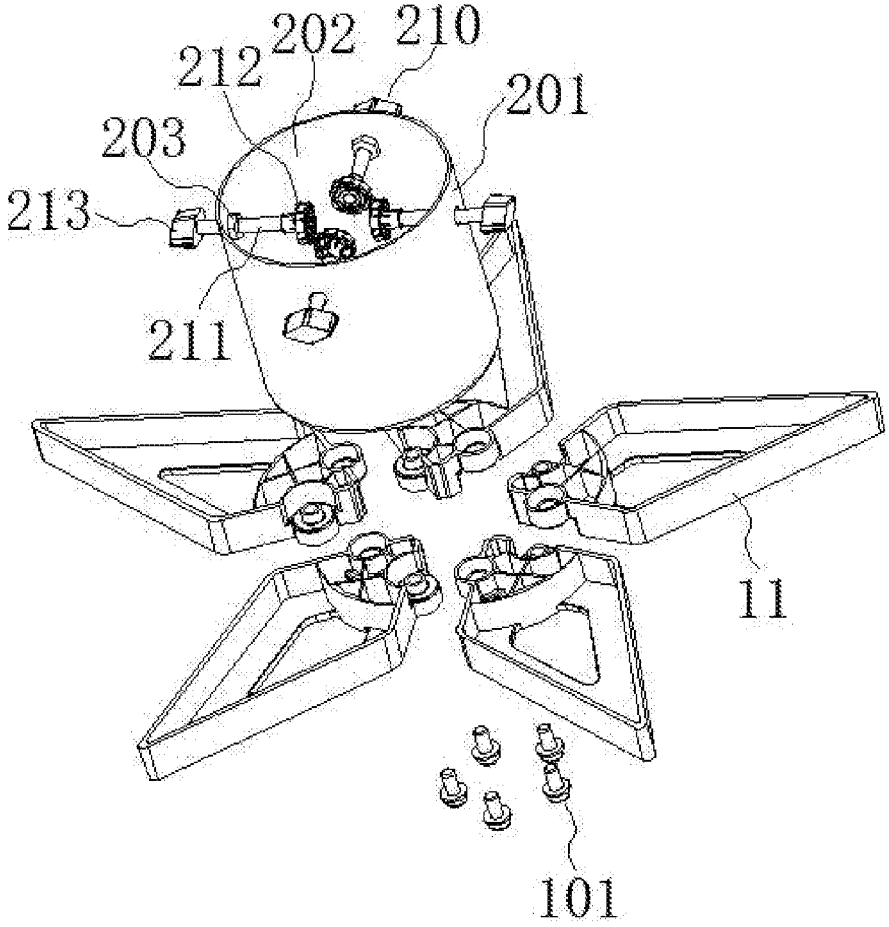
FIG. 3 is a schematic exploded view according to the embodiment as illustrated in FIG. 1, showing a schematic exploded view of a support portion.

As illustrated in FIG. 3, the carrier portion 200 includes a carrier cylinder 201, wherein the carrier cylinder 201 is hollowed out to define a carrier cavity 202 configured to accommodate the trunk of the Christmas tree (more particularly, a lower end of the trunk). The carrier cylinder 201 is further provided with adjustment portions 210 running through a side wall of the carrier cylinder 201, wherein the adjustment portions 210 are adjustably engaged on the carrier cylinder 201 via a threaded structure such that a front end of the adjustment portion 210 is stretchable or retractable in the carrier cavity 202 to fix trunks of Christmas trees in different dimensions.

When fixing the Christmas tree, the adjustment portion 210 is retracted outward first, then the lower end of the trunk of the Christmas tree is placed in the carrier cavity 202 and positioned between front ends of the adjustment portions 210, and finally the positions of the adjustment portions 210 are adjusted such that the adjustment portions 210 stretch inward to abut against the trunk to achieve a fixing effect. Upon fixing, a bottom surface of the lower end of the trunk is in contact with a bottom surface of the carrier cavity 202, a side wall of the lower end of the trunk is abutted against and fixed by the adjustment portion 210, such that the Christmas tree is fixed.

Figure 10:
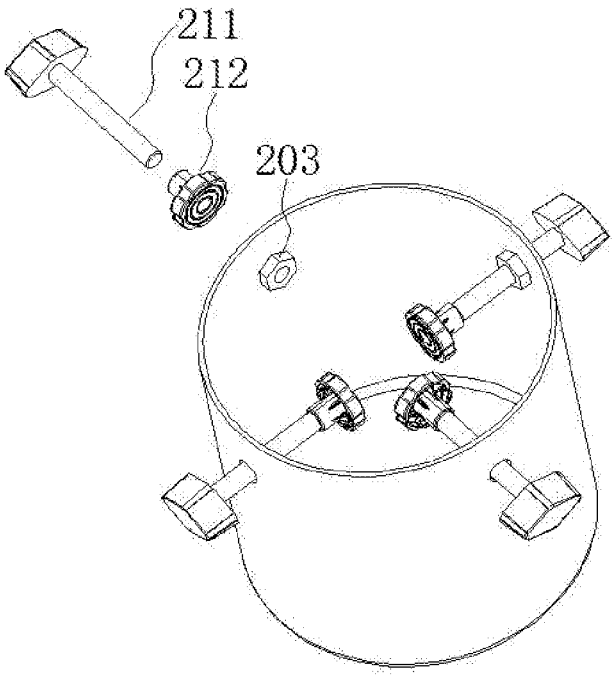
FIG. 10 is a schematic partial exploded view of the carrier portion according to the embodiment as illustrated in FIG. 1.

As illustrated in FIG. 3 and FIG. 10, the adjustment portion 210 includes an adjustment rod 211, wherein male threads are formed on an outer surface of the adjustment rod 211, and female threads are correspondingly formed on the side wall of the carrier cylinder 201, such that the adjustment rod 211 is screwed in or screwed out relative to the side wall. An abutment portion 212 configured to abut against the trunk is arranged at a front end of the adjustment rod 211, and an operation end 213 configured to facilitate rotation of the adjustment rod 211 is arranged at a rear end of the adjustment rod 211, for example, a handle or a bolt head portion.

In this embodiment, a run-through through hole is arranged in the side wall of the carrier cylinder 201, wherein a first fixing portion 203 is welded on an inner wall of the through hole. The first fixing portion 203 is a nut. In this case, the inner wall of the through hole may be provided with female threads or nor provided with female threads.

As illustrated in FIG. 10, in this embodiment, the abutment portion 212 is sleeved onto the front end of the adjustment rod 211, the operation end 213 and the adjustment rod 211 are fixed to each other, integrally formed, or insert molded.

In this embodiment, four adjustment portions 210 are evenly arranged along a circumferential direction, that is, evenly arranged to define a 90-degree angle therebetween. Nevertheless, in other embodiments, the number of adjustment portions 210 may be other values, or the adjustment portions 210 are not evenly arranged. The abutment portion 212 is also not limited to the circular shape as illustrated in the drawings, and may also be in other shapes, for example, a spike end or an arc shape.

As illustrated in FIG. 3, the support portion 100 and the carrier portion 200 are fixed to each other by a plurality of first fixing members 101, for example, fixing screws.

Figure 5:
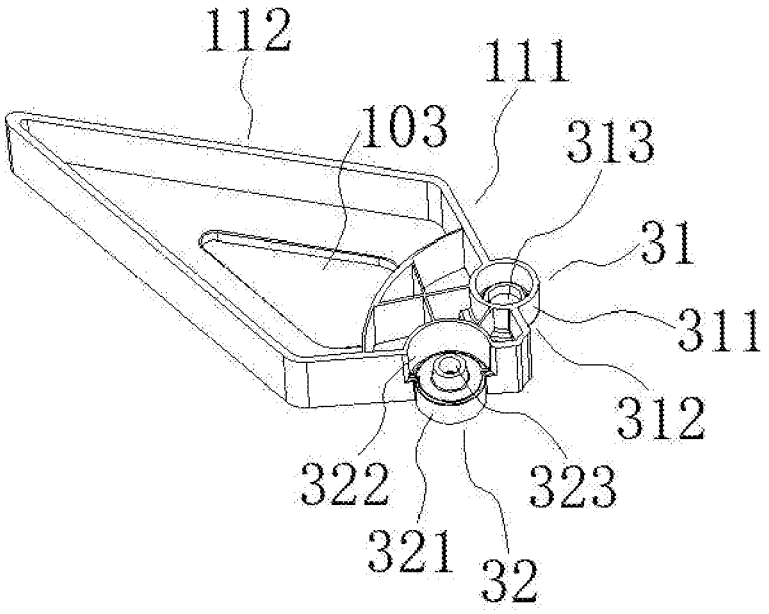
FIG. 5 is a schematic top view of a single support member according to the embodiment as illustrated in FIG. 1.
Figure 6:
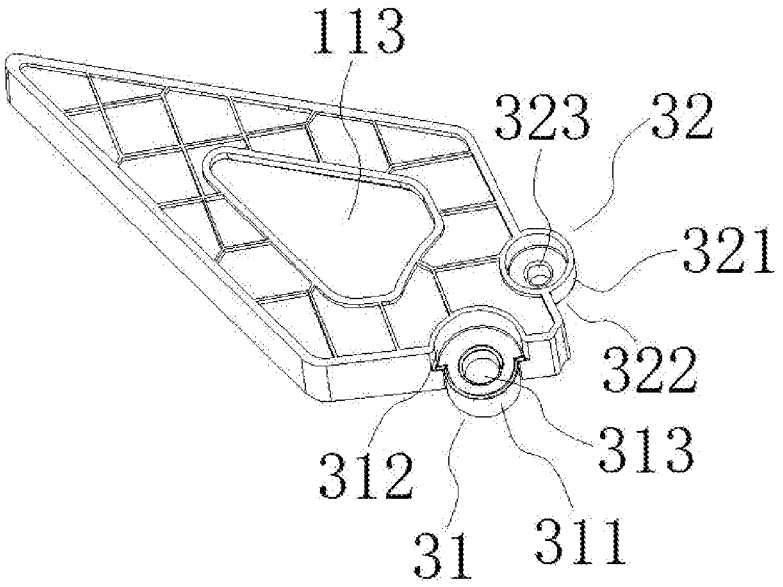
FIG. 6 is a schematic bottom view of FIG. 5.
Figure 7:
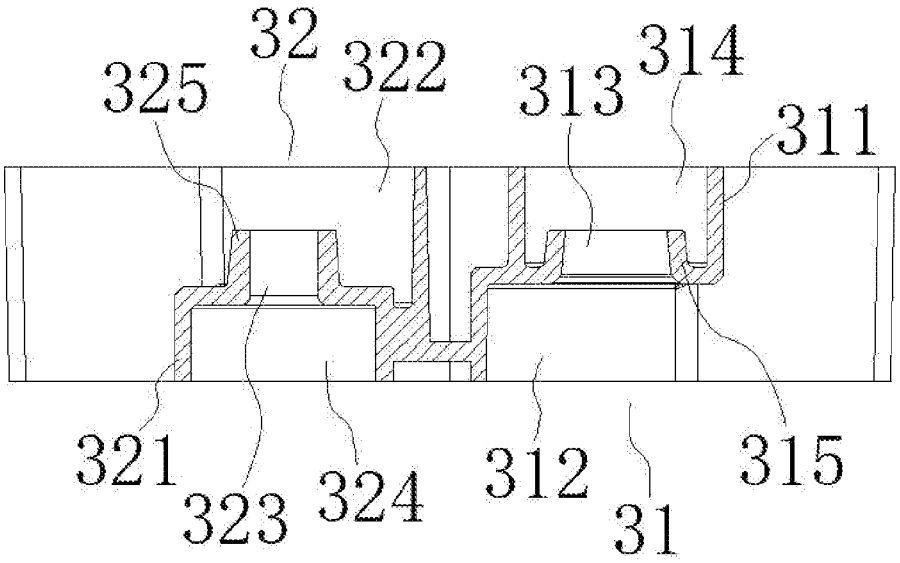
FIG. 7 is a sectional view of FIG. 5, which is a sectional view taken along a vertical section through the center of two connection holes.
Figure 8:
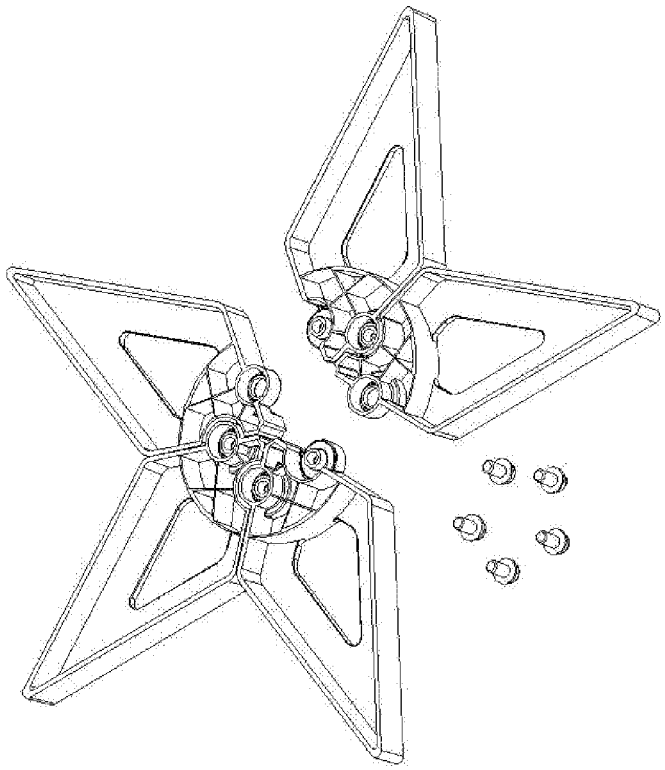
FIG. 8 is a schematic view of an assembling process of the support portion according to the embodiment as illustrated FIG. 1.

As illustrated in FIG. 5 to FIG. 7, the support member 11 includes a first support portion 111 and a second support portion 112, wherein the first support portion 111 is arranged at a position in an inner side direction, and the second support portion 112 is arranged at a position in an outer side direction.

Figure 4:
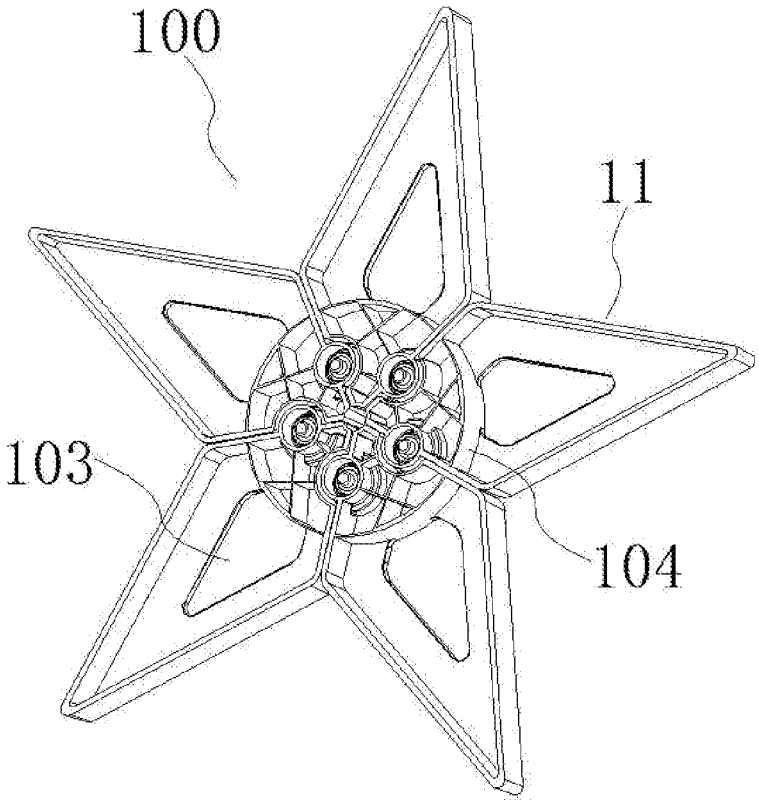
FIG. 4 is a schematic structural view of a support portion of the assembled stand according to the embodiment as illustrated in FIG. 1.

As illustrated in FIG. 4 and FIG. 5, each of the support members 11 is provided with a hollowed-out hole 103 for weight reduction, and inner sides of the support members 11 collaboratively form a support region 104 for arranging the carrier cylinder 201, wherein grid-like support reinforcement ribs are arranged in the support region 104 to enhance a structural strength.

As illustrated in FIG. 5 to FIG. 7, a first connection portion 31 and a second connection portion 32 are respectively arranged on two inner sides of the support member 11.

When the support members 11 are engaged with each other, the first connection portion 31 of any of the support members 11 is engaged with the second connection portion 32 of its adjacent support member 11. The support members 11 are successively arranged along a circumferential direction, such that the first connection portions 31 and the second connection portions 32 of the support members 11 are successively engaged, and the connection portions form an annular arrangement.

The first connection portion 31 includes a first engagement portion 311, a second engagement portion 312 that are arranged along a vertical direction, and a first connection hole 313 that is arranged to run through the first engagement portion 311 and the second engagement portion 312. The second connection portion 32 includes a third engagement portion 321 and a fourth engagement portion 322 that are arranged along a vertical direction, and a second connection hole 323 that is arranged to run through the third engagement portion 321 and the fourth engagement portion 322. In addition, in this embodiment, the second engagement portion 312 and the fourth engagement portion 322 are cavities.

When the support members 11 are successively engaged with each other and are formed as the support portion as illustrated in FIG. 4, the first engagement portion 311 of a support member 11 is engaged with the fourth engagement portion 322 of its adjacent support member 11, the third engagement portion 321 of the support member 11 is engaged to the second engagement portion 312 of its adjacent support member 11, and the first connection hole 313 is arranged to be opposite to the second connection hole 323, such that the first fixing member 101 runs through the first connection hole 313 and the second connection hole 323 and is then fixed to a bottom surface of the carrier cylinder 201. The first connection hole 313 and the second connection hole 323 are both annular through holes, such that the first fixing member 101 runs through the connection holes and is fixed to achieve a better fixing effect on the support members 11, thereby preventing the support members 11 from falling off.

As illustrated in FIG. 7, in this embodiment, the first engagement portion 311 and the second engagement portion 312, or the third engagement portion 321 and the fourth engagement portion 322 are engaged with each other along a horizontal plane. Nevertheless, in other embodiments, the engagement portions may also be engaged with each other along an inclined plane or a step surface. However, the first engagement portion 311, the second engagement portion 312, the third engagement portion 321, and the fourth engagement portion 322 are all contiguously arranged, such that any of the first fixing members 101 is capable of simultaneously fixing two adjacent fixing members 11.

Figure 9:
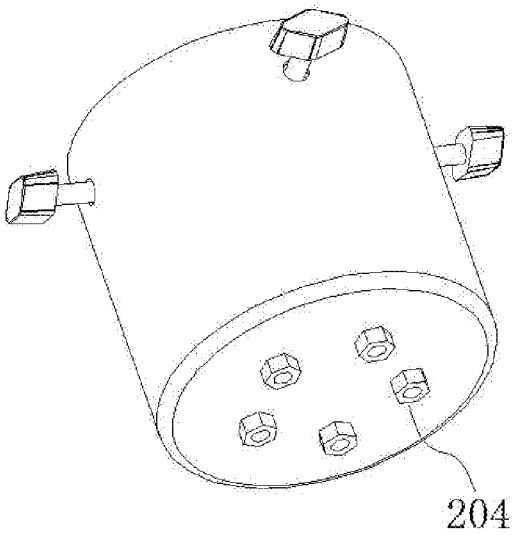
FIG. 9 is a schematic structural view of a carrier portion according to the embodiment as illustrated in FIG. 1.

As illustrated in FIG. 9, in this embodiment, a plurality of nuts acting as the second fixing portions 204 are welded on the bottom surface of the carrier cylinder 201. The first fixing member 101 is screwed into the nut to achieve connection therebetween.

In this embodiment, the two fixing portions 203 and 204 are both practiced by nuts, and are fixed to the inner wall and the bottom surface of the carrier cylinder 201 by welding. Compared with the fashion of directly opening a hole and making female threads on the side wall and the bottom face of the carrier cylinder 201, this achieves a higher structural strength, and is advantageous in manufacture cost. Further, as for opening the hole in the bottom face for use in a real tree, water needs to be injected into the carrier cavity 202 such that the real tree is kept alive, which also exerts adverse impacts.

In this embodiment, a first cavity portion 314 is further arranged inside the first engagement portion 311 of the first connection portion 31, and a second cavity portion 324 is further arranged inside the third engagement portion 321 of the second connection portion 32. The first cavity portion 314 is configured to accommodate the second fixing portion 204, and the second cavity portion 324 is configured to accommodate the head portion of the first fixing member 101, such that an upper surface of the support portion 100 is in contact with the bottom surface of the carrier cylinder 201, and a lower surface of the support portion 100 is in contact with the ground. In this way, the arrangement of the second fixing member 204 or the first fixing member 101 may not cause an uneven contact between the support portion 100 and the carrier portion 200, or between the support portion 100 and the ground.

In this embodiment, the third engagement portion 321 further includes a first positioning portion 325 that is protruded, wherein the second connection hole 323 is arranged in the first positioning portion 325, such that the first positioning portion 325 is arranged around the second connection hole 323. The first engagement portion 311 includes a second positioning portion 315 arranged around the first connection hole 313, such that during assembling, interactions between the two positioning portions cause the support portion 100 to be initially positioned to facilitate bodily movement. When the first positioning portion 325 is engaged to the second positioning portion 315, upper edges of the two positioning portions are substantially flush with each other, such that adjacent support members 11 are simultaneously fixed by the first fixing member 101.

In a preferred embodiment, the second positioning portion 315 has an inner diameter less than an outer diameter of the first positioning portion 325, such that the two positioning portions are arranged in an interference fit manner. During assembling of two adjacent support members 11, initial positioning may be achieved by engagement between the two positioning portions. Nevertheless, in other embodiments, the interface fit may be not configured between the two positioning portions 325 and 315.

Since the support members 11 are engaged with each other successively end to end along a circumferential direction, the first positioning portion 325 that is protruded is engaged to the first positioning portion 325 that is recessed to achieve positioning connection between the support members 11, such that upon assembling, the support portion 100 may be formed as a bodily movable or takable entirety, which is conducive to assembling. Nevertheless, besides the above concave-convex engagement structure, snap-fit structures for snap-fitting to each other may also be arranged on adjacent support members 11; or the first positioning portion 325 and the second positioning portion 315 may be spaced apart from the two connection holes 313 and 323.

In summary, the support members 11 may be connected to each other by a positioning mechanism. The positioning mechanism includes a first positioning member and a second positioning member; wherein the first positioning member and the second positioning member are respectively arranged on two adjacent support members 11 and are engaged with each other when the support members are connected end to end along the circumferential direction and are formed as the support portion 100, and the first positioning member and the second positioning member are engaged with each other in a concave-convex or snap-fit manner such that the support members 11 are connected. Preferably, the first positioning member and the second positioning member are engaged with each other along a vertical direction, such that the connection is achieved by means of end-to-end engagement between the adjacent support members 11, in stead of totally depending on a connection force between the two positioning members.

As illustrated in FIG. 5 to FIG. 7, in this embodiment, the first engagement portion 311 and the second engagement portion 321 are both columnar members, the second engagement portion 312 and the fourth engagement portion 322 are both columnar cavities, the first positioning portion 325 is protruded from the third engagement portion 321, and the second positioning portion 315 is recessed on the first engagement portion 311. When the inclined plane is engaged with the step surface, it is equivalent to adaptations to the contact surface between the two on the basis of the horizontal engagement as illustrated in FIG. 5 to FIG. 7, that is, the contact surfaces of the two are inclined, or concave and convex to form a step shape.

When the first and second positioning portions are arranged, since the first positioning portion 325 needs to be engaged to the second positioning portion upon engagement, some variations may be caused to the position and orientation of the support members 11 during assembling. In this case, direct translation may fail to cause the first positioning portion 325 to be engaged to the second positioning portion 315. The first positioning portion 325 may be engaged to the second positioning portion 315 by rotating one of the support members 11 about its central line as an axis by a specific angle. In addition, with respect to the stand for the Christmas tree having five legs, the support portion 100 may be assembled as follows: three support members 11 and two support members 11 are separately assembled first, and then the two parts are assembled to obtain the support portion that is preliminarily assembled but not fixed, as illustrated in FIG. 4. Due to a fit clearance, during assembling the three support members and the two support members, the part constituted by the two support members 11 may be rotated about the axis by a small degree, such that the first positioning portion 325 is engaged with the second positioning portion 315. Upon the assembling, due to interactions between the first positioning portion 325 and the second positioning portion 315, the support members 11 form a pre-assembly body that may be preliminarily positioned. In this case, even when one support member 11 is taken away, the entirety formed by the five support members 11 may be moved and taken away.

In other embodiments, when the first positioning portion 325 and the second positioning portion 315 are not arranged, the part constituted by the two support members 11 may be translated and engaged with each other, such that the first connection portion 31 and the second connection portion 32 are engaged with each other. However, under the engagement, the support members 11 are loose, which are not conducive to the subsequently assembling but are useful.

In this embodiment, adjacent support members 11 are fixed by the same first fixing member 101. In this way, the number of parts is reduced, and the assembling operations are simplified. In addition, among the support members 11, by the interactions between the two positioning portions 325 and 315, the support portion 100 is preliminarily positioned by virtue of the structural characteristics of the support members 11 when the fixing member is not used, such that upon the preliminary assembling, the support portion 100 may be formed as an bodily-movable or takable entire pre-assembled piece, which is conducive to subsequent assembling.

Further, the support portion 100 is further provided with two cavity portions 314 and 324, such that upper and lower surfaces of the support portion 100 are flush with each other.

Second Embodiment

Figure 11:
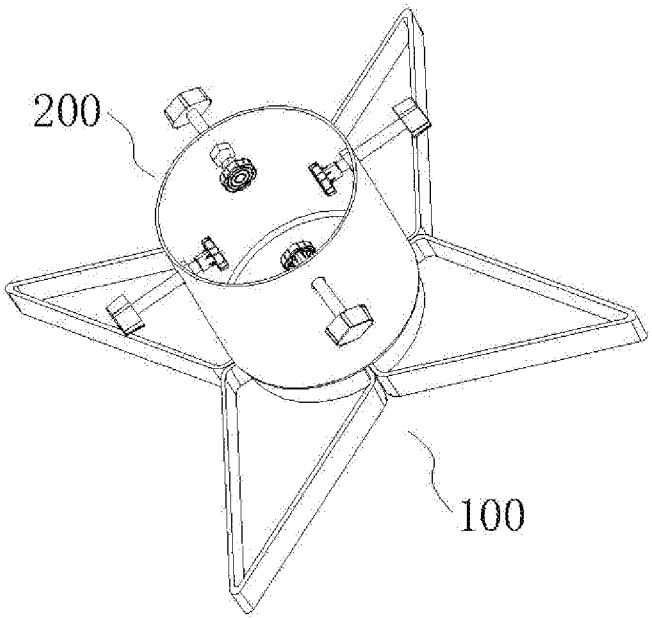
FIG. 11 is a schematic structural view of an assembled stand for a Christmas tree according to a second embodiment of the present disclosure.

As illustrated in FIG. 11, an assembled stand for a Christmas tree is provided. The main structure is the same as that of the assembled stand according to the first embodiment. The difference lies in that in this embodiment, the support portion 100 is constituted by four support members 11 that are assembled.

In this embodiment, during assembling of the support portion 100, each two support members 11 are first assembled to form parts, and the formed parts are assembled together to form an entirety, and finally, the entirety is fixed to the bottom surface of the carrier cylinder 201 by the first fixing member 101.

Third Embodiment

Figure 12:
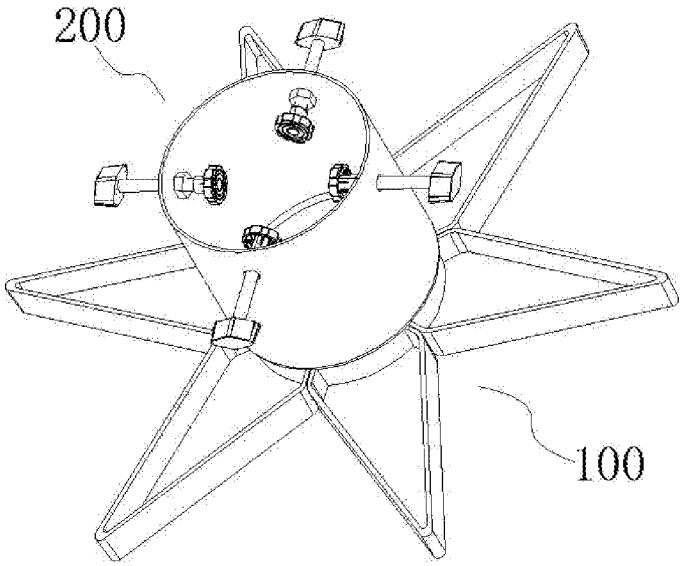
FIG. 12 is a schematic structural view an assembled stand for a Christmas tree according to a third embodiment of the present disclosure.

As illustrated in FIG. 12, an assembled stand for a Christmas tree is provided. The main structure is the same as that of the assembled stand according to the first embodiment. The difference lies in that in this embodiment, the support portion 100 is constituted by six support members 11 that are assembled.

In this embodiment, during assembling of the support portion 100, each three support members 11 are first assembled to form a part and the formed parts are assembled together, or four support members and two support members 11 are respectively assembled to form two parts and the two parts are then assembled, to form the assembled support portion 100, and finally, the support portion 100 is fixed to the bottom surface of the carrier cylinder 201 by the first fixing member 101.

What is claimed is:

1. An assembled stand for a Christmas tree, comprising:

a support portion, comprising at least three support members, the support members being successively arranged along a circumferential direction such that two sides of each of the support members are connected end to end and are formed as the support portion; and a carrier portion connected to the support portion, the carrier portion comprising a carrier cylinder, the carrier cylinder being hollowed to define a carrier cavity configured to fix the Christmas tree, wherein the support portion and the carrier portion are fixed to each other via a first fixing member;

wherein a first connection portion and a second connection portion are arranged on two sides of each of the support members, such that when the support members are engaged with each other end to end, the first connection portion and the second connection portion of two adjacent support members of the at least three support members are engaged with each other; wherein the first connection portion comprises a first engagement portion, a second engagement portion and a first connection hole, and the second connection portion comprises a third engagement portion, a fourth engagement portion, a second connection hole and a first positioning portion; wherein the first engagement portion and the second engagement portion are arranged along a vertical direction, and the first connection hole is arranged to run through the first engagement portion and the second engagement portion; the third engagement portion and the fourth engagement portion are arranged along a vertical direction, the second connection hole is arranged to run through the third engagement portion and the fourth engagement portion, and the first positioning portion is protruded from the third engagement portion; and the first engagement portion and the third engagement portion are columnar members, and the second engagement portion and the fourth engagement portion are columnar cavities;

wherein when the support members are connected end to end and are formed as the support portion, the first engagement portion of any of the support members is engaged to the fourth engagement portion of an adjacent support member, the third engagement portion of any of the support members is engaged to the second engagement portion of an adjacent support member, the first positioning portion is engaged to the first connection hole such that the first connection hole is arranged to be opposite to the second connection hole, and the first fixing member runs through the first connection hole and the second connection hole and is then fixed to the carrier cylinder.

2. The assembled stand for the Christmas tree according to claim 1, wherein the first engagement portion comprises a second positioning portion arranged around the first connection hole; wherein the first positioning portion is engaged to the second positioning portion and upper edges of the two positioning portions are flush with each other; and the first positioning portion is protruded from the third engagement portion, and the second positioning portion is recessed on the first engagement portion.

3. The assembled stand for the Christmas tree according to claim 2, wherein the first engagement portion and the second engagement portion, or the third engagement portion and the fourth engagement portion are engaged with each other along a horizontal plane; and the first connection hole and the second connection hole are both annular through holes.

4. The assembled stand for the Christmas tree according to claim 1, wherein the number of support members is 3, 4, 5, or 6; the first fixing member is a screw; the support members are arranged to extend outward horizontally or arranged to extend outward and downward, and tail ends of the support members are in a same horizontal plane; each of the support members is provided with a hollowed-out hole for weight reduction, and inner sides of the support members collaboratively form a support region for arranging the carrier cylinder, grid-like support reinforcement ribs being arranged in the support region to enhance a structural strength.

5. The assembled stand for the Christmas tree according to claim 4, wherein the carrier cylinder is further provided with an adjustment portion running through a side wall of the carrier cylinder, the adjustment portion being adjustably engaged on the carrier cylinder via a threaded structure; wherein the adjustment portion comprises an adjustment rod, male threads being formed on an outer surface of the adjustment rod, an abutment portion being arranged at a front end of the adjustment rod, and an operation end being arranged at a rear end of the adjustment rod; a run-through through hole is arranged in the side wall of the carrier cylinder, a first fixing portion being welded on an inner wall of the through hole, the first fixing portion being a nut; a plurality of second fixing portions are welded on a bottom surface of the carrier cylinder, the second fixing portions are nuts; and a first cavity portion is further arranged inside the first engagement portion, and a second cavity portion is further arranged inside the third engagement portion of the second connection portion, the second fixing portion being accommodated in the first cavity portion.

6. An assembled stand for a Christmas tree, comprising: a support portion, comprising at least three support members, the support members being successively arranged along a circumferential direction such that two sides of each of the support members are connected end to end and are formed as the support portion; and a carrier portion connected to the support portion, the carrier portion comprising a carrier cylinder, the carrier cylinder being hollowed to define a carrier cavity configured to fix the Christmas tree, wherein the support portion and the carrier portion are fixed to each other via a first fixing member;

wherein a first connection portion and a second connection portion are arranged on two sides of each of the support members, such that when the support members are engaged with each other end to end, the first connection portion and the second connection portion of two adjacent support members of the at least three support members are engaged with each other; wherein the first connection portion comprises a first engagement portion and a second engagement portion that are arranged along a vertical direction, and a first connection hole arranged to run through the first engagement portion and the second engagement portion; and the second connection portion comprises a third engagement portion and a fourth engagement portion that are arranged along the vertical direction, and a second connection hole arranged to run through the third engagement portion and the fourth engagement portion; and wherein when the support members are connected end to end and are formed as the support portion, the first engagement portion of any of the support members is engaged to the fourth engagement portion of an adjacent support member, the third engagement portion of any of the support members is engaged to the second engagement portion of an adjacent support member, the first connection hole is arranged to be opposite to the second connection hole, and the first fixing member runs through the first connection hole and the second connection hole and is then fixed to the carrier cylinder.

7. The assembled stand for the Christmas tree according to claim 6, wherein the first engagement portion and the second engagement portion, or the third engagement portion and the fourth engagement portion are engaged with each other along a horizontal plane, an inclined plane or a step surface; and the first connection hole and the second connection hole are both annular through holes.

8. The assembled stand for the Christmas tree according to claim 6, wherein the carrier cylinder is further provided with an adjustment portion running through a side wall of the carrier cylinder, the adjustment portion being adjustably engaged on the carrier cylinder via a threaded structure; wherein the adjustment portion comprises an adjustment rod, male threads being formed on an outer surface of the adjustment rod, an abutment portion being arranged at a front end of the adjustment rod, and an operation end being arranged at a rear end of the adjustment rod; a run-through through hole is arranged in the side wall of the carrier cylinder, a first fixing portion being welded on an inner wall of the through hole, the first fixing portion being a nut; a plurality of second fixing portions are welded on a bottom surface of the carrier cylinder, the second fixing portions are nuts; and a first cavity portion is further arranged inside the first engagement portion, and a second cavity portion is further arranged inside the third engagement portion of the second connection portion, the second fixing portion being accommodated in the first cavity portion.

9. The assembled stand for the Christmas tree according to claim 6, wherein the number of support members is 3, 4, 5, or 6; and the first fixing member is a screw.

10. The assembled stand for the Christmas tree according to claim 9, wherein the support members are arranged to extend outward horizontally or arranged to extend outward and downward, and tail ends of the support members are in a same horizontal plane; each of the support members is provided with a hollowed-out hole for weight reduction, and inner sides of the support members collaboratively form a support region for arranging the carrier cylinder, grid-like support reinforcement ribs being arranged in the support region to enhance a structural strength.

11. A support member for an assembled stand for a Christmas tree, comprising:

a first connection portion, comprising a first engagement portion and a second engagement portion that are arranged along a vertical direction, and a first connection hole arranged to run through the first engagement portion and the second engagement portion; and a second connection portion; wherein the first connection portion and the second connection portion are respectively arranged on two sides of the support member; and the second connection portion comprises a third engagement portion and a fourth engagement portion that are arranged along the vertical direction, and a second connection hole arranged to run through the third engagement portion and the fourth engagement portion;

wherein the first engagement portion and the third engagement portion are protrusions, and the second engagement portion and the fourth engagement portion are recesses such that the engagement portions are engaged with each other in a concave-convex manner when at least three of the support members for an assembled stand for a Christmas tree are connected end to end along a circumferential direction; and the first connection hole and the second connection hole are arranged to be opposite to each other such that the same fixing member is capable of simultaneously fixing two adjacent support members of the at least three support members.

12. The support member for the assembled stand for the Christmas tree according to claim 11, further comprising: a positioning mechanism, comprising a first positioning member and a second positioning member; wherein the first positioning member and the second positioning member are respectively arranged on two adjacent support members and are engaged with each other when the support members are connected end to end along the circumferential direction and are formed as the support portion, and the first positioning member and the second positioning member are engaged with each other in a concave-convex or snap-fit manner such that the support members are connected.

13. The support member for the assembled stand for the Christmas tree according to claim 12, wherein the first engagement portion and the second engagement portion, or the third engagement portion and the fourth engagement portion are engaged with each other along a horizontal plane, an inclined plane or a step surface; and the first connection hole and the second connection hole are both annular through holes.

14. The support member for the assembled stand for the Christmas tree according to 12, wherein the first positioning member is a first positioning portion arranged on the third engagement portion and is protruded around the second connection hole, the second positioning member is formed by the first connection hole, and the first positioning member and the second positioning member are engaged with each other in a concave-convex manner such that the support members are connected; wherein the first positioning portion is engaged to the first connection hole such that the first connection hole and the second connection hole are arranged to be opposite to each other.

15. The support member for the assembled stand for the Christmas tree according to claim 14, wherein the first engagement portion comprises a second positioning portion arranged around the first connection hole, wherein the first positioning portion is engaged to the second positioning portion and upper edges of the two positioning portions are flush with each other.

16. The support member for the assembled stand for the Christmas tree according to claim 14, wherein the first engagement portion and the third engagement portion are both columnar members, and the second engagement portion and the fourth engagement portion are both columnar cavities; the first positioning portion is protruded from the third engagement portion, and the second positioning portion is recessed on the first engagement portion; and two adjacent support members are fixed by the same first fixing member.

17. The support member for the assembled stand for the Christmas tree according to claim 16, wherein a first cavity portion is further arranged inside the first engagement portion, and a second cavity portion is further arranged inside the third engagement portion of the second connection portion; the support members are each provided with a hollowed-out hole for weight reduction, and grid-like support reinforcement ribs are arranged on inner sides of the support members; and the first fixing member is a fixing screw.

* * * * *